US008057002B2

(12) United States Patent
Koseki et al.

(10) Patent No.: US 8,057,002 B2
(45) Date of Patent: Nov. 15, 2011

(54) METHOD OF DRIVING AN INK-JET HEAD, INK-JET HEAD, AND INK-JET RECORDING APPARATUS

(75) Inventors: Osamu Koseki, Chiba (JP); Yuki Yamamura, Chiba (JP)

(73) Assignee: SII Printek Inc. (JP)

( * ) Notice: Subject to any disclaimer, the term of this patent is extended or adjusted under 35 U.S.C. 154(b) by 247 days.

(21) Appl. No.: 12/082,548

(22) Filed: Apr. 10, 2008

(65) Prior Publication Data

US 2008/0266338 A1 Oct. 30, 2008

(30) Foreign Application Priority Data

Apr. 25, 2007 (JP) ..... 2007-115928

(51) Int. Cl.
*B41J 29/38* (2006.01)

(52) U.S. Cl. ..... 347/11; 347/12; 347/15

(58) Field of Classification Search ..... None
See application file for complete search history.

(56) References Cited

U.S. PATENT DOCUMENTS

| | | | | |
|---|---|---|---|---|
| 6,059,393 | A | 5/2000 | Takahashi | 347/11 |
| 2004/0061731 | A1 | 4/2004 | Fujimura et al. | 347/11 |
| 2006/0017780 | A1 | 1/2006 | Hara | 347/54 |

FOREIGN PATENT DOCUMENTS

| | | |
|---|---|---|
| EP | 1149704 | 10/2001 |
| EP | 1616704 | 1/2006 |
| EP | 1661705 | 5/2006 |

*Primary Examiner* — Matthew Luu
*Assistant Examiner* — Justin Seo
(74) *Attorney, Agent, or Firm* — Adams & Wilks

(57) ABSTRACT

Provided is an ink-jet head and an ink-jet type recording apparatus for improving an impact position accuracy of ink droplets by eliminating a discharge speed difference of ink droplets when an ink volume is changed gradually in a plurality of steps to perform gradation expression. Among discharge pulse signals to be applied a plurality of times for gradually changing and discharging the ink droplet volume, a signal waveform of a final drive pulse and a signal waveform of an initial drive pulse to be operated at least once before the final drive pulse, are varied from each other so as to establish a predetermined relation therebetween.

7 Claims, 16 Drawing Sheets

T1
T1
T1
T1
T1
V
tμs
Final Drive Pulse

T2
T4
T1
V
tμs
Initial Drive Pulse

T3
T5
T2
T4
T1
V
tμs
Initial Drive Pulse
Final Drive Pulse

T3a
T5a
T2a
T4a
T1
V
tμs
t1
t2
t3
t4
t5
t6

FIG. 9

| Initial Drive Pulse | | Region of Discharge Condition |
|---|---|---|
| Application Time (μs) | T1/ Application Time | |
| 7.6 | 1 | R2 |
| 6.9 | 1.1 | |
| 6.3 | 1.2 | |
| 5.8 | 1.3 | |
| 5.4 | 1.4 | |
| 5.1 | 1.5 | R1 |
| 4.8 | 1.6 | |
| 4.5 | 1.7 | |
| 4.2 | 1.8 | |
| 4.0 | 1.9 | |
| 3.8 | 2 | |
| 3.6 | 2.1 | |
| 3.5 | 2.2 | |
| 3.3 | 2.3 | |
| 3.2 | 2.4 | |
| 3.0 | 2.5 | |
| 2.9 | 2.6 | |
| 2.8 | 2.7 | |
| 2.7 | 2.8 | |
| 2.6 | 2.9 | |
| 2.5 | 3 | R3 |
| 2.5 | 3.1 | |

Control Target

T1 = 7.6 μs

FIG. 10

| Initial Drive Pulse | | Region of Discharge Condition |
|---|---|---|
| Application Time (μs) | Application Time / T1 | |
| 7.6 | 1 | R2 |
| 8.0 | 1.05 | |
| 8.4 | 1.1 | |
| 8.7 | 1.15 | |
| 9.1 | 1.2 | R1 |
| 9.5 | 1.25 | |
| 9.9 | 1.3 | |
| 10.3 | 1.35 | |
| 10.6 | 1.4 | |
| 11.0 | 1.45 | |
| 11.4 | 1.5 | |
| 11.8 | 1.55 | |
| 12.2 | 1.6 | |
| 12.5 | 1.65 | |
| 12.9 | 1.7 | |
| 13.3 | 1.75 | |
| 13.7 | 1.8 | |
| 14.1 | 1.85 | R3 |
| 14.4 | 1.9 | |
| 14.8 | 1.95 | |
| 15.2 | 2 | |
| 15.6 | 2.05 | |

Control Target

T1 = 7.6 μs

FIG. 22A-I
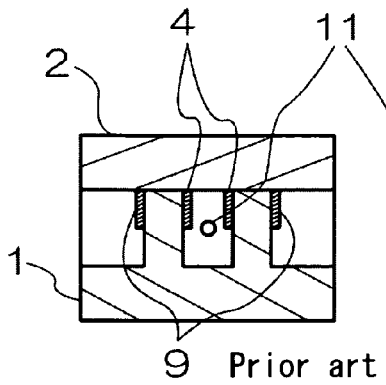
FIG. 22A-II
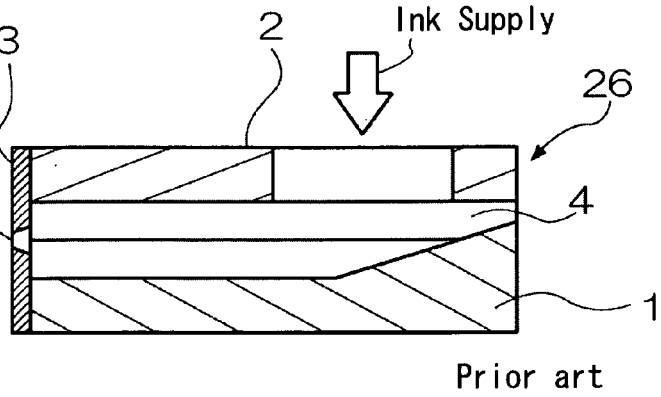
FIG. 22B-I
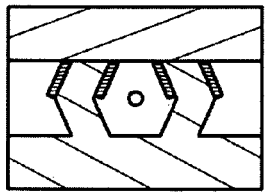
Prior art
FIG. 22B-II
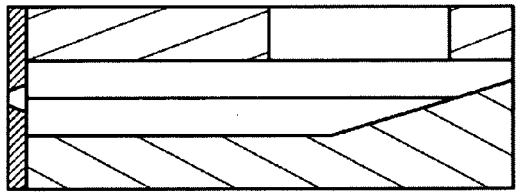
Prior art
FIG. 22C-I
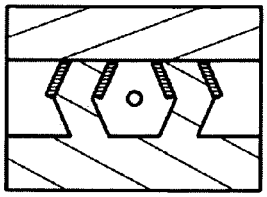
Prior art
FIG. 22C-II
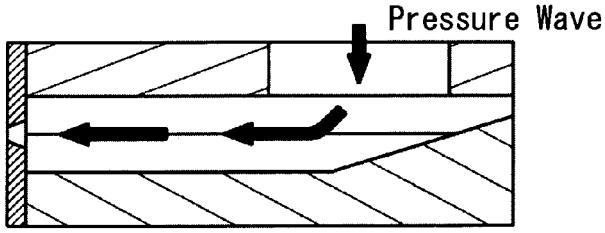
Prior art
FIG. 22D-I
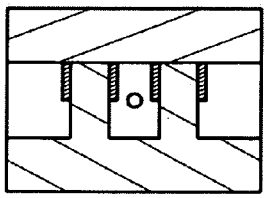
Prior art
FIG. 22D-II
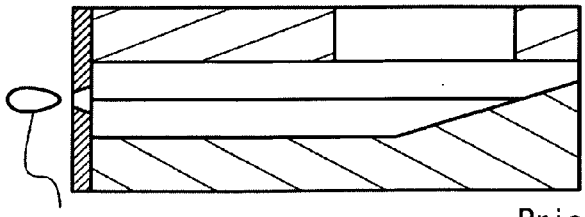
Prior art

METHOD OF DRIVING AN INK-JET HEAD, INK-JET HEAD, AND INK-JET RECORDING APPARATUS

BACKGROUND OF THE INVENTION

1. Field of the Invention

The present invention relates to a method of driving an ink-jet head for discharging ink droplets to record an image on a recording medium, and an ink-jet recording apparatus.

2. Description of the Related Art

Conventionally, there has been known an ink-jet type recording apparatus for recording a character and an image on a recording medium by employment of an ink-jet head having a plurality of nozzles for discharging ink. FIG. 1 is a schematic front view showing an ink-jet head 100, FIG. 2 is a schematic cross-sectional view thereof, and FIG. 3 is an exploded diagram showing a periphery of a driving part for generating a pressure necessary for discharge of ink and of a nozzle part from which ink is finally discharged.

As shown in FIG. 3, in a piezoelectric ceramic plate 1, a plurality of grooves 5 are arranged in parallel with each other, and the grooves 5 are separated from each other by side walls 7. One end of each of the grooves 5 in a longitudinal direction thereof extends to one end surface of the piezoelectric ceramic plate 1. The other end thereof does not extend to the other end surface of the piezoelectric ceramic plate 1, and a depth of each of the grooves 5 gradually decreases. In addition, on the side walls 7 on both sides of each of the grooves 5 on the opening side, there are formed an electrode 4 and an electrode 9 for driving electric field application in the longitudinal direction.

Further, on the opening side of the grooves 5 of the piezoelectric ceramic plate 1, there is formed a head chip 26 which is joined to an ink chamber plate 2. To the end surface at which the grooves 5 of a joined body of the piezoelectric ceramic plate 1 and the ink chamber plate 2 are opened, a nozzle plate 3 is joined. In the nozzle plate 3, a plurality of nozzle holes 11 are formed at positions opposite to every other groove 5. The nozzle plate 3 and the head chip 26 are each fixed by a head cap 12. The electrode 4, the electrode 9, and a drive circuit substrate 14, which are formed on the head chip 26, are electrically connected to each other via a flexible substrate 19.

Further, on the ink chamber plate 2, an ink flow path 21 for supplying ink to each of the grooves 5 is fixed, an ink inlet 41 for introducing ink is formed at a central portion of the ink flow path 21, and the ink inlet 41 is connected to a pressure absorbing unit 20 for absorbing a pressure fluctuation caused during a printing operation.

Next, a method of driving the ink-jet head 100 structured as described above will be described with reference to FIGS. 20A to 20C, 4A, and 4B. FIGS. 20A to 20C are diagrams each showing a discharge signal waveform of the ink-jet head 100 according to a related art. FIGS. 4A and 4B are cross-sectional diagrams each showing a wiring state of the electrodes of the ink-jet head 100. FIG. 20A is a diagram showing a discharge signal waveform in a case of discharging ink with a volume of one droplet according to the related art. FIG. 20B is a diagram showing a discharge signal waveform in a case of discharging ink with a volume of two droplets according to the related art. FIG. 20C is a diagram showing a discharge signal waveform in a case of discharging ink with a volume of three droplets according to the related art. FIG. 4A is a cross-sectional diagram of the ink-jet head when the ink-jet head is not driven, and FIG. 4B is a cross-sectional diagram of the ink-jet head when the ink-jet head is driven. The arrow 6 indicates a polarization direction. When an electric field is applied to the electrode 4 and the electrode 9 which sandwich the side wall 7, each of the side walls 7 deforms in a desired direction. In other words, the side walls 7 are each structured as an actuator which is deformed and operated in response to an applied voltage to be applied to each of the electrode 4 and the electrode 9.

As shown in FIG. 4A, the ink-jet head 100 has an electrode structure in which the electrode 4 formed in each of the grooves 5 is a common electrode with a ground potential, and the electrodes 9 sandwiching the electrode 4 are each applied with a drive pulse from an outside. When a positive electric field pulse, which is represented by a discharge signal waveform for the ink with the volume of one droplet as shown in FIG. 20A, is applied to each of the electrodes 9, the side walls 7 are each deformed due to a potential difference between the electrode 9 and the electrode 4 as shown in FIG. 4B. The side walls 7 are each deformed for a time T1*b* during which the positive electric field is applied to each of the electrodes 9. When a potential of the electrode 9 becomes 0 after the elapse of the time T1*b*, the side walls 7 each return to a state shown in FIG. 4A again. Note that the time T1*b* is set as a most efficient time at which the discharge speed is increased as being apparent from FIG. 19 showing a relation between an electric field application time and a discharge speed. Due to the deformation of each of the side walls 7, the ink filled in each of the grooves 5 changes in pressure, whereby one ink droplet is allowed to fly from the nozzle hole 11.

Further, the positive electric field is applied a plurality of times so as to change a discharge volume of the ink flying onto the recording medium from each of the nozzle holes 11, thereby making it possible to perform gradation expression. For example, in order to discharge the ink with the volume of two droplets from each of the nozzle holes 11, the positive pulse (application time T2*b*) is operated before the positive electric field pulse (application time T1*b*) during an interval of a time T4*b* as shown in FIG. 20B. In a similar manner, in the case of discharging the ink with the volume of three droplets, the positive electric field pulse (application time T3*b*) is operated before the positive electric field pulses (application times T1*b* and T2*b*) as shown in FIG. 20C. As a result, the ink with the volume of three droplets can be allowed to fly from the nozzle hole 11. The times for application of the positive electric field pulse and the pulse interval times (rest times) of this case are represented as T1*b*=T2*b*=T3*b*=T4*b*=T5*b*. In other words, the times for application of the positive electric field pulse with a predetermined voltage for deforming and operating the actuator formed of each of the side walls 7 to allow the ink to fly from each of the nozzle holes 11, are set to be equal to each of the rest times between pulse application operations, during which the actuator is not driven. As a result, the ink can be discharged with efficiency.

FIG. 21 shows a relation between a fluctuation of a pressure P of each of the nozzle holes 11 and a drive voltage between the electrode 4 and the electrode 9. In FIG. 21, a time T1 corresponds to the time T1*b* of FIG. 19. FIGS. 22A-I to 22D-II each schematically show a behavior of each of the side walls 7, a change in pressure of each of the nozzle holes 11, and the ink flow path. FIGS. 22A-I to 22D-II are cross-sectional diagrams each showing the nozzle plate 3 and the head chip 26. FIGS. 22A-I, 22B-I, 22C-I, and 22D-I each show the nozzle plate 3 and the head chip 26 viewed from an axial direction of the nozzle holes 11, and FIGS. 22A-II, 22B-II, 22C-II, and 22D-II are side views thereof. FIGS. 22A-I and 22A-II each show a state obtained before application of the drive pulse in FIG. 21, FIGS. 22B-I and 22B-II each show a state at a time (time t11) when the drive pulse application is started in FIG. 21, and FIGS. 22C-I to 22D-II each show a state at a time (time t12) when the drive pulse application is finished in FIG. 21.

When the drive pulse is applied at the time t11, the pressure P of each of the nozzle holes 11 is rapidly changed into a negative pressure P1 simultaneously with the fluctuation (increase in volume) of each of the side walls 7 (see FIG. 22B-I and 22B-II). Then, the ink is gradually filled, and the pressure once returns to 0 (pressure P2). Further, the pressure fluctuates to a positive side by a force of a caused wave. When the ink is supplied from an ink supply port formed in the ink chamber plate 2, the pressure in the flow path is increased, and the pressure P becomes a peak value after the elapse of the time T1 (pressure P3) (see FIG. 22C-I and 22C-II) Then, when the drive voltage is returned to 0 at the time t12 after the elapse of the time T1 when the pressure P becomes the peak value, the side walls 7 are each returned to the original state shown in FIGS. 22A-I and 22A-II. When the volume of the ink is reduced as compared with that in the state shown in FIGS. 22B-I to 22C-II, the ink can be allowed to fly from each of the nozzle holes 11 with efficiency (FIGS. 22D-I and 22D-II). After that, the fluctuation in pressure of each of the nozzle holes 11 is repeatedly caused with a time twice as much as the time T1 being as one cycle, and gradually decreases.

However, in the case of the method of driving the ink jet head according to the related art by employment of drive waveforms shown in FIGS. 20A, 20B, and 20C, as apparent from the relation between the electric field applied voltage and the discharge speed shown in FIG. 23, there is a problem in that there is generated a discharge speed difference among one droplet, two droplets, and three droplets of ink. The discharge speed in each case of discharging the ink with the volumes of two droplets and three droplets is higher than that in the case of discharging one droplet. This is because an effect of the pressure change generated during the driving operation at the time T3*b* and the time T2*b* remains, and an remainder of a vibration due to the driving operation is added, thereby increasing the discharge speed. There is a problem in that, when the printing operation is performed by an ink-jet printer, the difference in discharge speed generated in this case is appeared as a difference in impact positions of ink droplets, thereby deteriorating an image quality of a printed material.

SUMMARY OF THE INVENTION

In view of the above-mentioned circumstances, it is an object of the present invention to provide a method of driving an ink-jet head for improving an impact position accuracy of ink droplets by eliminating a difference in discharge speed caused due to a difference in volume of ink corresponding to one droplet, two droplets, and three droplets for performing gradation expression, an ink-jet head, and an ink-jet recording apparatus.

In order to achieve the above-mentioned object, according to a first aspect of the present invention, there is provided a method of driving an ink-jet head, the ink-jet head including: a plurality of side walls each formed of an actuator which is deformed and operated in response to an applied voltage; a plurality of grooves arranged in parallel with each other between the plurality of side walls so as to communicate with nozzles; an ink flow path for supplying ink to each of the plurality of grooves; an electrode provided on each of the plurality of side walls; application means which applies a drive pulse with a predetermined voltage for deforming and operating the actuator to allow the ink to fly from the nozzles to the electrode with a rest time during which the actuator is prevented from being operated being provided; and control means which generates the drive pulse a plurality of times to be applied to the electrode by the application means to change a volume of ink droplets reaching a recording medium, the method including: varying, by the control means, a duration of a final drive pulse to be finally applied and a duration of an initial drive pulse to be applied at least once before the final drive pulse from each other among the drive pulses generated the plurality of times; and varying the rest time by an amount corresponding to a time difference between the duration of the final drive pulse and the duration of the initial drive pulse to set a total time with the rest time corresponding to the duration of each of the drive pulses to be constant, and setting the duration of the initial drive pulse to a range of value from 1/1.5 to 1/2.9 of the duration of the final drive pulse, when the duration of the final drive pulse and the duration of the initial drive pulse are varied from each other.

According to a second aspect of the present invention, the control means sets the duration of the initial drive pulse to a range of value from 1/1.7 to 1/2.5 of the duration of the final drive pulse.

According to a third aspect of the present invention, there is provided a method of driving an ink-jet head, the ink-jet head including: a plurality of side walls each formed of an actuator which is deformed and operated in response to an applied voltage; a plurality of grooves arranged in parallel with each other between the plurality of side walls so as to communicate with nozzles; an ink flow path for supplying ink to each of the plurality of grooves; an electrode provided on each of the plurality of side walls; application means which applies a drive pulse with a predetermined voltage for deforming and operating the actuator to allow the ink to fly from the nozzles to the electrode with a rest time during which the actuator is prevented from being operated being provided; and control means which generates the drive pulse a plurality of times to be applied to the electrode by the application means to change a volume of ink droplets reaching a recording medium, the method including: varying, by the control means, a duration of a final drive pulse to be finally applied and a duration of an initial drive pulse to be applied at least once before the final drive pulse from each other among the drive pulses generated the plurality of times; and varying the rest time by an amount corresponding to a time difference between the duration of the final drive pulse and the duration of the initial drive pulse to set a total time with the rest time corresponding to the duration of each of the drive pulses to be constant, and setting the duration of the initial drive pulse to a range of value from 1.2 to 1.8 times as much as the duration of the final drive pulse, when the duration of the final drive pulse and the duration of the initial drive pulse are varied from each other.

According to a fourth aspect of the present invention, the control means sets the duration of the initial drive pulse to a range of value from 1.35 to 1.75 of the duration of the final drive pulse.

According to a fifth aspect of the present invention, there is provided a method of driving an ink-jet head, the ink-jet head including: a plurality of side walls each formed of an actuator which is deformed and operated in response to an applied voltage; a plurality of grooves arranged in parallel with each other between the plurality of side walls so as to communicate with nozzles; an ink flow path for supplying ink to each of the plurality of grooves; an electrode provided on each of the plurality of side walls; application means which applies a drive pulse with a predetermined voltage for deforming and operating the actuator to allow the ink to fly from the nozzles to the electrode with a rest time during which the actuator is prevented from being operated being provided; and control means which generates the drive pulse a plurality of times to be applied to the electrode by the application means to change a volume of ink droplets reaching a recording medium, in which: the control means varies a duration of a final drive pulse to be finally applied and a duration of an initial drive pulse to be applied at least once before the final drive pulse from each other among the drive pulses generated the plurality of times; and the rest time is varied by an amount corresponding to a time difference between the duration of the final drive pulse and the duration of the initial drive pulse to set a total time with the rest time corresponding to the duration of each of the drive pulses to be constant, and the duration of the initial drive pulse is set to a range of value from 1/1.5 to 1/2.9 of the duration of the final drive pulse or a range of value from 1.2 to 1.8 times as much as the duration of the final drive pulse, when the duration of the final drive pulse and the duration of the initial drive pulse are varied from each other.

According to a sixth aspect of the present invention, there is provided an ink-jet recording apparatus including: the ink-jet head according to the fifth aspect of the present invention; an ink supply part for supplying ink to the ink-jet head; and recording medium transport means which transports a recording medium onto which ink is discharged from the ink-jet head.

Further, according to another aspect of the present invention, the present invention is characterized in that a signal waveform of the final drive pulse for allowing ink with an appropriate volume of n−1 droplets (n is an integer equal to or larger than 2) to fly is synchronized with a signal waveform of the final drive pulse for allowing ink with an appropriate volume of n droplets to fly.

According to the present invention, the control means varies the duration of the final drive pulse to be finally applied, from the duration of the initial drive pulse to be applied once or more before the final drive pulse, among the drive pulses to be generated a plurality of times with the predetermined voltage. In this case, the rest time is varied by a time difference between the duration of the final drive pulse and the duration of the initial drive pulse, thereby setting a total time with each rest time corresponding to the duration of each of the drive pulses to be constant, and setting the duration of the initial drive pulse to 1/1.5 or 1/2.9 of the duration of the final drive pulse or 1.2 times or 1.8 times as much as the duration of the final drive pulse. As a result, there can be provided an ink-jet head and an ink-jet type recording apparatus for eliminating a difference in discharge speed for ink droplets, which is caused when the ink with the volume of a plurality of droplets, that is, one droplet, two droplets, and three droplets in the case of performing the gradation expression, and for improving an impact position accuracy of ink droplets to thereby provide an excellent image quality.

BRIEF DESCRIPTION OF THE DRAWINGS

In the accompanying drawings:

FIG. 9 is a table showing confirmation results of the discharge state according to an example of the embodiment of the present invention;

FIG. 10 is a table showing confirmation results of the discharge state according to an example of the embodiment of the present invention;

FIGS. 22A-I to 22D-II are schematic diagrams each showing an ink flow path for representing a behavior and a change in pressure of each of side walls of the related art.

DETAILED DESCRIPTION OF THE PREFERRED EMBODIMENTS

Figure 1:
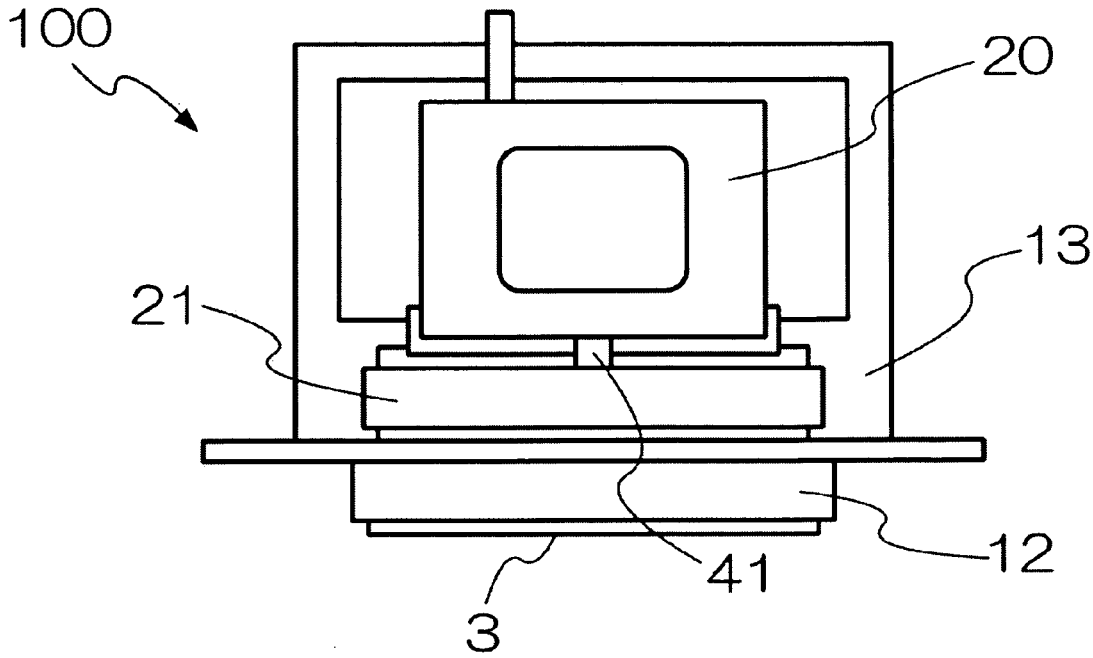
FIG. 1 is a front view showing an entirety of an ink-jet head according to an embodiment of the present invention.
Figure 2:
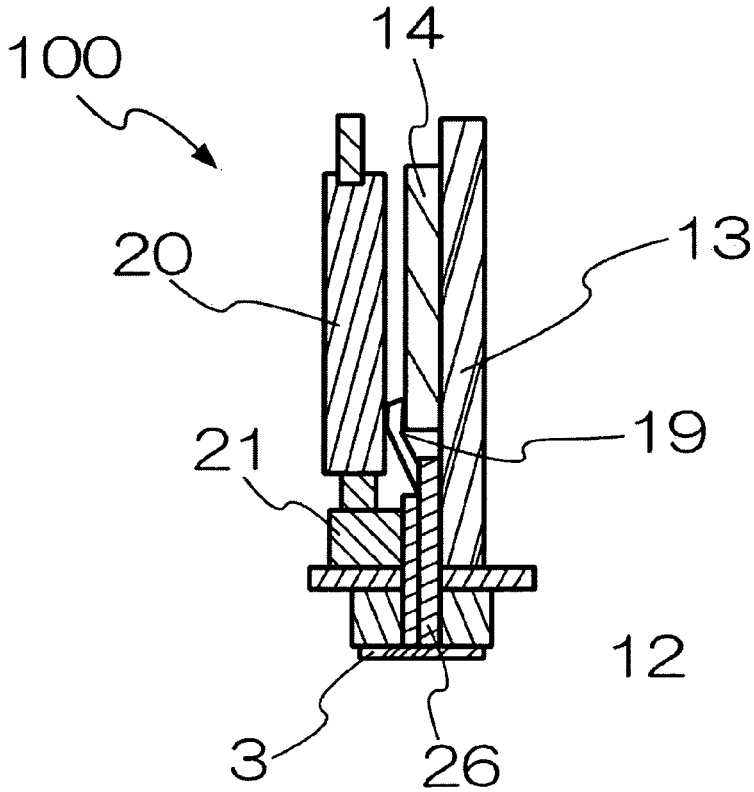
FIG. 2 is a schematic cross-sectional diagram of the entirety of the ink-jet head according to the embodiment of the present invention.
Figure 3:
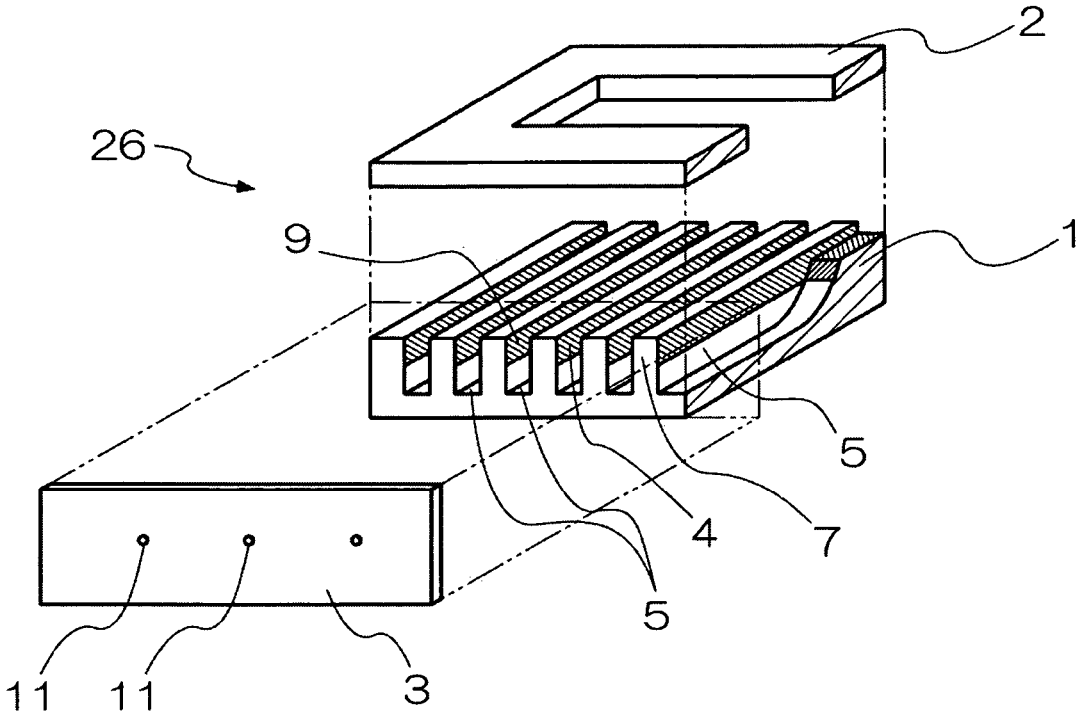
FIG. 3 is an exploded diagram showing a periphery of a discharge pressure generating part according to the embodiment of the present invention.

Hereinafter, the present invention will be described according to embodiments of the present invention. FIG. 1 is a front view showing an entirety of an ink-jet head 100 according to an embodiment of the present invention. FIG. 2 is a schematic cross-sectional diagram showing the ink-jet head 100 according to the embodiment of the present invention. FIG. 3 is an exploded diagram showing a periphery of a discharge pressure generating part of the ink-jet head 100 according to the embodiment of the present invention.

As shown in FIGS. 1 to 3, the ink-jet head 100 according to the embodiment of the present invention includes a head chip 26, an ink flow path 21 provided on one side of the head chip 26, a drive circuit substrate 14 on which a drive circuit for driving the head chip 26 and the like are mounted, and a pressure absorbing unit 20 for absorbing a pressure change in the head chip 26. Those components are each fixed to a base 13.

Next, a detailed description is given of the periphery of the head chip 26 which becomes a generation source for discharging ink. As shown in FIG. 3, in a piezoelectric ceramic plate 1 constituting the head chip 26 formed of a piezoelectric ceramic plate, a plurality of grooves 5 which communicate with nozzle holes 11 are arranged in parallel with each other, and the grooves 5 are separate from each other by side walls 7.

One end of each of the grooves 5 in a longitudinal direction extends to one end surface of the piezoelectric ceramic plate 1, and the other end thereof does not extend to the other end surface of the piezoelectric ceramic plate 1, and a depth of each of the grooves 5 gradually decreases. In addition, on both sides of the side walls 7 in a width direction of each of the grooves 5, there are formed an electrode 4 and an electrode 9 for driving electric field application in the longitudinal direction on an opening side of each of the grooves 5 (see FIG. 4).

The grooves 5 formed in the piezoelectric ceramic plate 1 are formed by, for example, a disc-like die cutter, and a portion of each of the grooves 5 whose depth gradually decreases is to be formed in a shape of the die cutter. The electrode 4 and the electrode 9 to be formed in each of the grooves 5 are formed by, for example, known deposition from an oblique direction. The electrode 4 and the electrode 9 provided on the opening side of the side walls 7 on both sides of each of the grooves 5 are each connected to one end of a flexible substrate 19. The other end of the flexible substrate 19 is connected to a drive circuit (not shown) formed on the drive circuit substrate 14. As a result, the electrode 4 and the electrode 9 are electrically connected to the drive circuit. In addition, the opening side of each of the grooves 5 of the piezoelectric ceramic plate 1 is connected to an ink chamber plate 2.

Note that the ink chamber plate 2 can be formed of a ceramic plate, a metal plate, or the like. However, when deformation of the ink chamber plate 2 after being joined to the piezoelectric ceramic plate 1 is taken into consideration, it is preferable to use a ceramic plate having a thermal expansion coefficient approximate to that of the piezoelectric plate 1.

Further, to the end surface at which the grooves 5 of a joined body of the piezoelectric ceramic plate 1 and the ink chamber plate 2, a nozzle plate 3 is joined. The nozzle holes 11 are formed at positions opposite to every other groove 5 of the nozzle plate 3, whereby the nozzle holes 11 are connected to the grooves 5.

In the embodiment of the present invention, the nozzle plate 3 has an area larger than that of the end surface at which the grooves 5 of the joined body of the piezoelectric ceramic plate 1 and the ink chamber plate 2 are opened. The nozzle plate 3 is obtained by forming the nozzle holes 11 in a polyimide film or the like by employment of, for example, an excimer laser device. In addition, on a surface of the nozzle plate 3, which is opposite to the recording medium, there is provided a water-repellent film (not shown) having water repellency for preventing adhesion of ink or the like.

Further, to an outer periphery on a side of the end surface at which the grooves 5 of the joined body of the piezoelectric ceramic plate 1 and the ink chamber plate 2 are opened, a head cap 12 for supporting the nozzle plate 3 is joined. The head cap 12 is joined to an outside of the end surface of the joined body of the nozzle plate 3, thereby stably holding the nozzle plate 3.

In the ink-jet head 100 of the embodiment of the present invention, the ink flow path 21 for supplying ink to each of the grooves 5 is fixed onto the ink chamber plate 2, an ink inlet 41 for introducing ink is formed at a central portion of the ink flow path 21, and the ink inlet 41 is connected to the pressure absorbing unit 20 for absorbing the pressure fluctuation caused during a printing operation. For example, the pressure absorbing unit 20 is filled with the ink from an ink tank (not shown) at the time of initial filling or the like, and the ink is introduced into the ink flow path 21. Finally, the grooves 5 are each filled with the ink.

Next, referring to FIGS. 5 and 4A and 4B, control for driving the electrode 4 and the electrode 9 will be described. As described above, the ink-jet head 100 of the embodiment of the present invention includes the head chip 26 having the electrode 4 and the electrode 9, and the drive circuit substrate 14 connected to the head chip 26 via the flexible substrate 19. The drive circuit substrate 14 is also connected to an ink-jet head drive control part 110 including a head control part 111 and an image data processing part 112. An ink-jet recording apparatus 120 including the ink-jet head 100 and the ink-jet head drive control part 110 is connected to a personal computer 200 or the like via a predetermined interface. Note that the ink-jet recording apparatus 120 also includes an ink supply part (not shown) for supplying ink to the ink-jet head 100, and a recording medium transport part (not shown) for transporting the recording medium on which the ink is discharged from the ink-jet head 100.

The drive circuit substrate 14 (application means) is formed of a circuit including a switching element for performing on/off control of the voltage to be applied to each of the electrode 4 and the electrode 9, and deforms and operates the actuator formed of each of the side walls 7, thereby applying the predetermined voltage for allowing ink to fly from each of the nozzle holes 11 to the electrode 4 and the electrode 9 while a rest time during which the actuator is not operated is provided. The head control part 111 supplies electrode applied voltage and control signals for performing on/off control for the switching element or the like to the drive circuit substrate 14, and applies a drive pulse with a predetermined voltage to each of the electrode 4 and the electrode 9, thereby performing control of starting and stopping of the discharge of ink in each of the nozzles 11. The image data processing part 112 creates image data corresponding to each of the nozzle holes 11 based on information inputted from the personal computer 200. In addition, the image data processing part 112 outputs binary signals for setting a timing for applying the voltage to each of the electrode 4 and the electrode 9 based on the created image data, thereby generating the drive pulse to be applied to each of the electrode 4 and the electrode 9 a plurality of times to perform control of changing the volume of ink droplets reaching the recording medium. When gradation control is not performed, for example, the image data processing part 112 outputs signals for instructing application or stopping the application of the voltage corresponding to each of the nozzle holes 11 based on the image data consisting of binary data (0 or 1). In a case of controlling gradation of four levels, the image data processing part 112 outputs signals for instructing the number of times of generation of the drive pulses for four types of discharge volumes (0 droplets, one droplet, two droplets, and three droplets) corresponding to each of the nozzle holes 11, based on image data consisting of quaternary data (0, 1, 2, and 3).

Figure 4A:
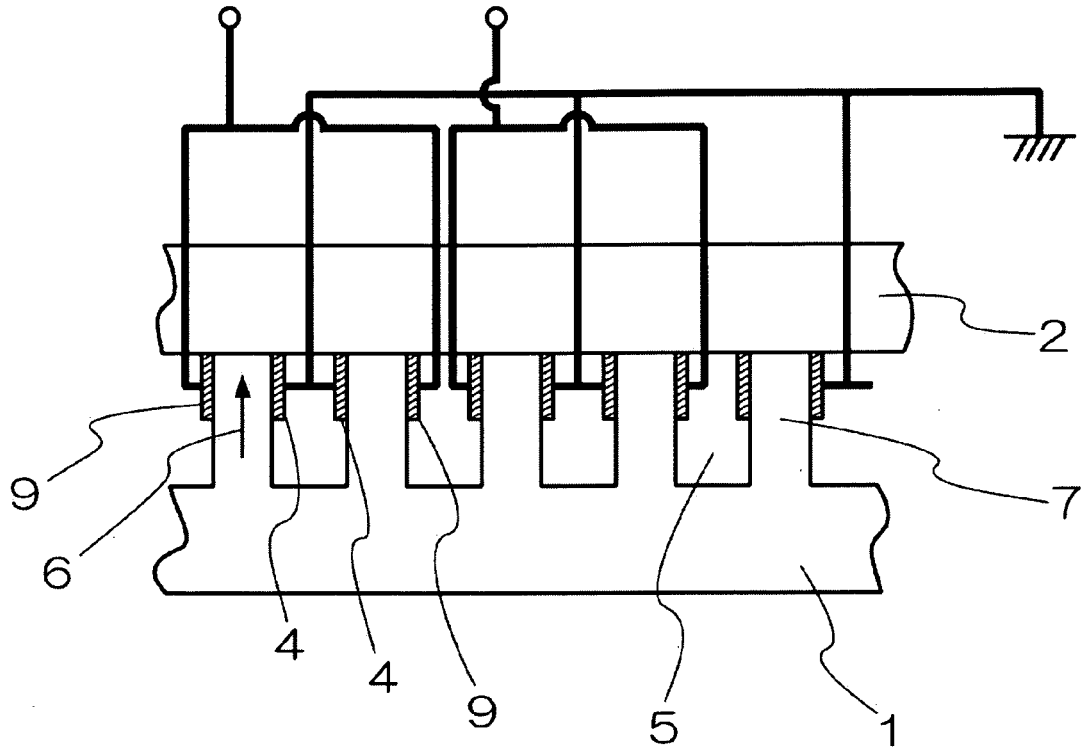
FIGS. 4A and 4B are cross-sectional diagrams each showing a wiring state of electrodes of the ink-jet head according to the embodiment of the present invention.
Figure 4B:
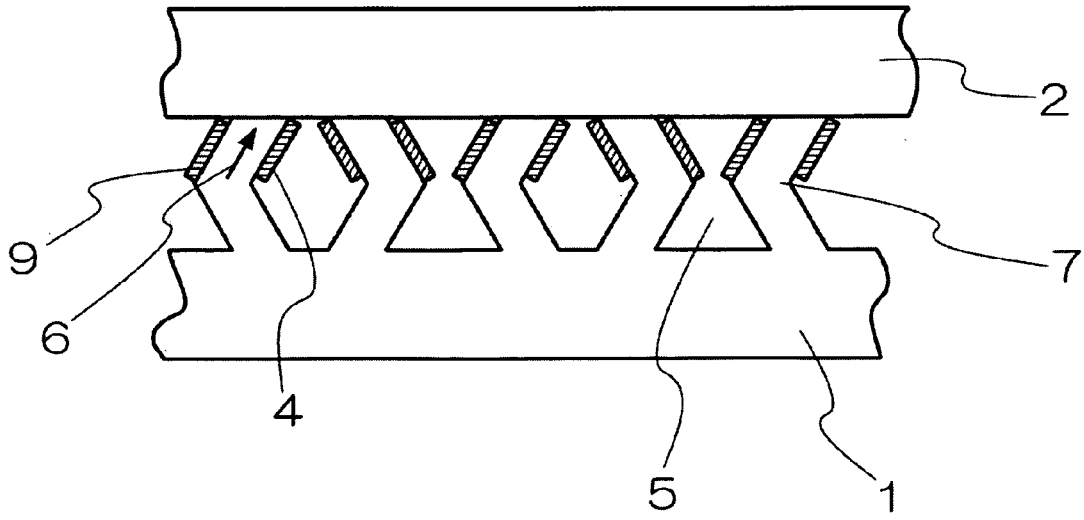
Figure 5:
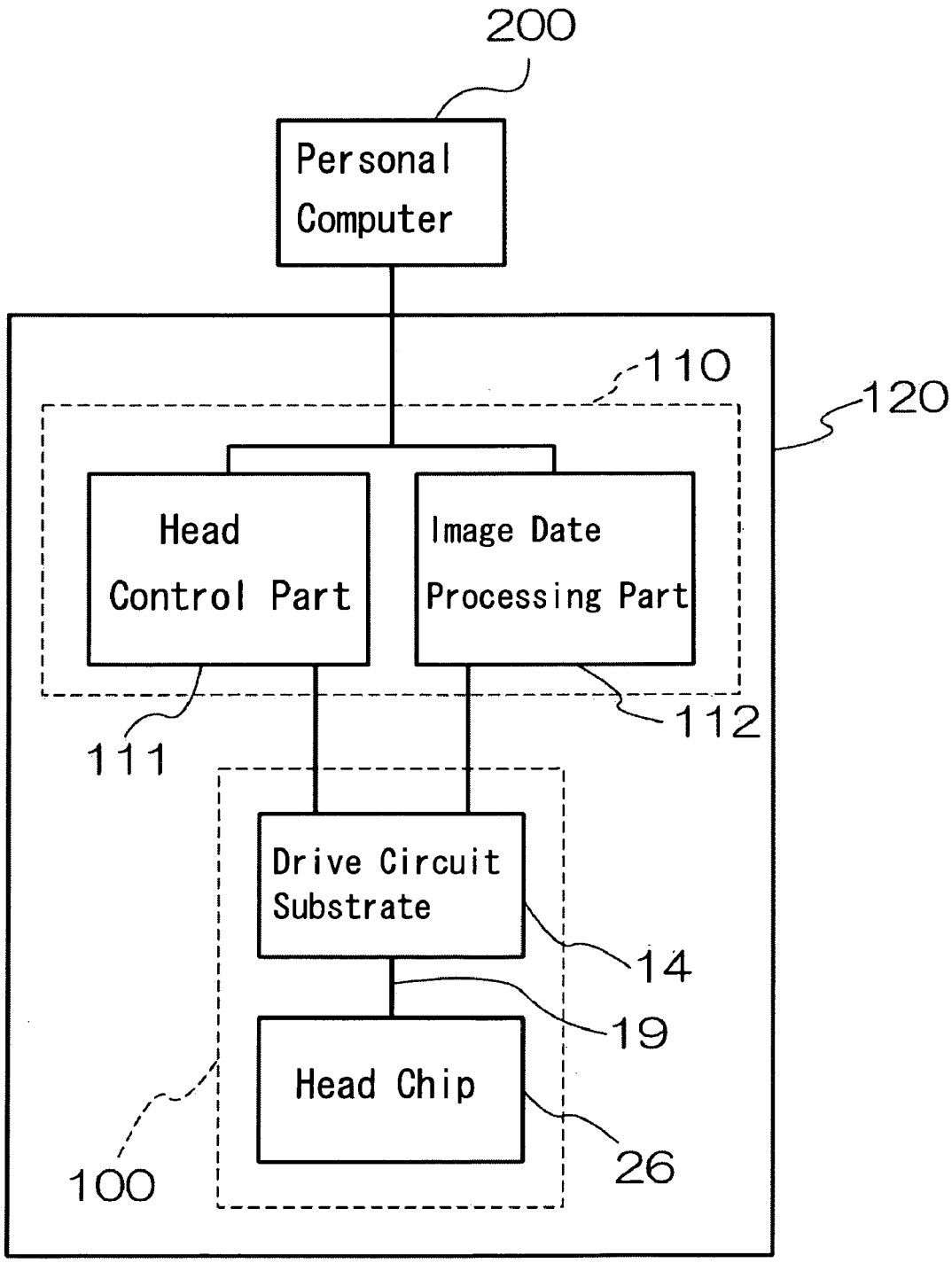
FIG. 5 is a block diagram showing an ink-jet recording apparatus according to the embodiment of the present invention.
Figures 6A, 6B, 6C, 6D:
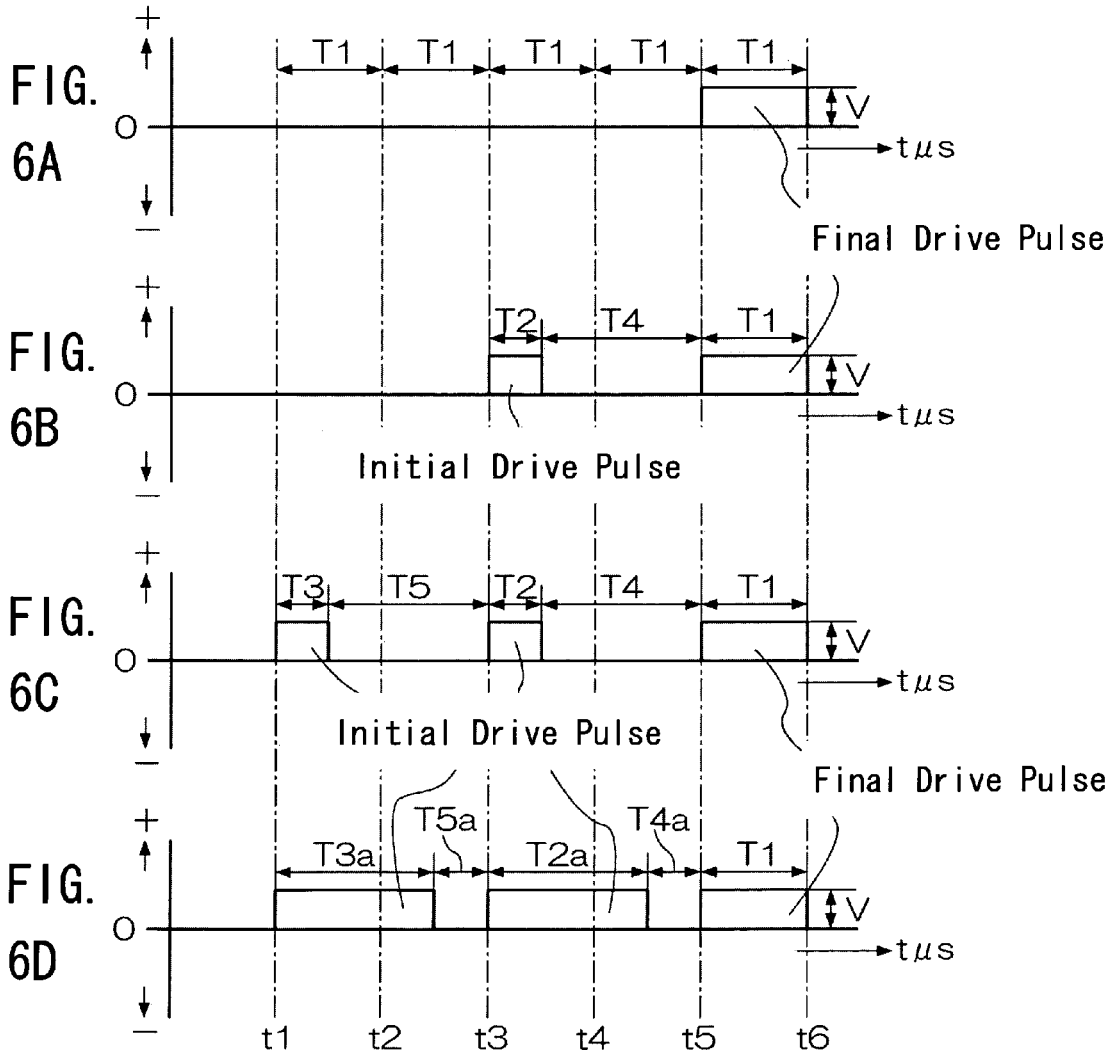
FIGS. 6A to 6D are diagrams each showing a discharge signal waveform of the ink-jet head according to the embodiment of the present invention.

Then, a description is given of a wiring method and a drive method for the electrodes of the embodiment of the present invention with reference to FIGS. 6A to 6D and 4A and 4B. FIGS. 6A to 6D are diagrams each showing a discharge signal waveform (drive pulse waveform of each of electrode 4 and electrode 9) of the ink-jet head 100 according to the embodiment of the present invention. FIGS. 4A and 4B are cross-sectional diagrams each showing a wiring state of the electrodes of the ink-jet head 100. FIG. 6A is a diagram showing a discharge signal waveform in a case of discharging ink with a volume of one droplet according to the embodiment of the present invention. FIG. 6B is a diagram showing a discharge signal waveform in a case of discharging ink with a volume of two droplets according to the embodiment of the present invention. FIG. 6C is a diagram showing a discharge signal waveform in a case of discharging ink with a volume of three droplets according to the embodiment of the present invention. FIG. 4A is a cross-sectional diagram of the ink-jet head when the ink-jet head is not driven, and FIG. 4B is a cross-sectional diagram of the ink-jet head when the ink-jet head is driven. The arrow 6 indicates a polarization direction. When an electric field is applied to each of the electrode 4 and the electrode 9 which sandwich the side wall 7, each of the side walls 7 deforms in a desired direction.

Figure 8:
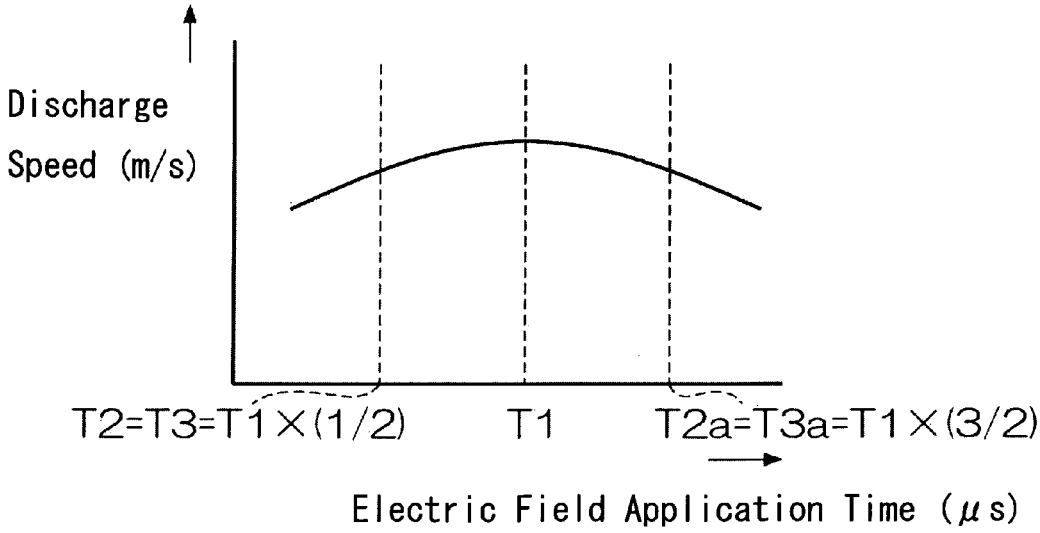
FIG. 8 is a graph showing a relation between an electric field application time and the discharge speed of the ink-jet head according to the embodiment of the present invention.

As shown in FIG. 4A, the ink-jet head 100 has an electrode structure in which the electrode 4 formed in each of the grooves 5 is a common electrode with a ground potential, and the electrodes 9 sandwiching the electrode 4 is applied with output signals from the outside. When a positive electric field pulse (drive pulse) shown in FIG. 6A is applied to each of the electrodes 9, the side walls 7 are each deformed due to a potential difference between the electrode 9 and the electrode 4 as shown in FIG. 4B. The side walls 7 are each deformed for a time T1 during which the positive electric field is applied to each of the electrodes 9, and when the potential of the electrode 9 becomes 0 after the elapse of the time T1, the side walls 7 each return to a state shown in FIG. 4A again. Note that the time T1 is set to the most efficient time at which the discharge speed is increased as being apparent from FIG. 8 showing the relation between the electric field application time and the discharge speed. The positive electric field pulse with the duration of the time T1, at which an efficient discharge speed is obtained, is referred to as final drive pulse. Due to the deformation of each of the side walls 7, the ink filled in each of the grooves 5 changes in pressure, whereby one ink droplet is allowed to fly from each of the nozzle holes 11.

Figure 20A:
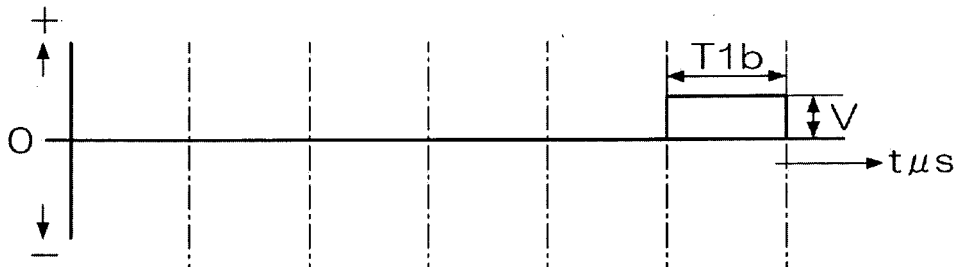
FIG. 20A Prior art
FIGS. 20A to 20C are diagrams each showing a discharge signal waveform of the ink-jet head of the related art.
Figure 20B:
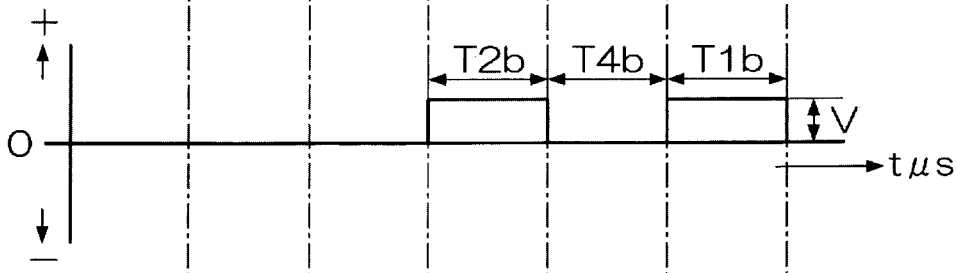
FIG. 20B Prior art
Figure 20C:
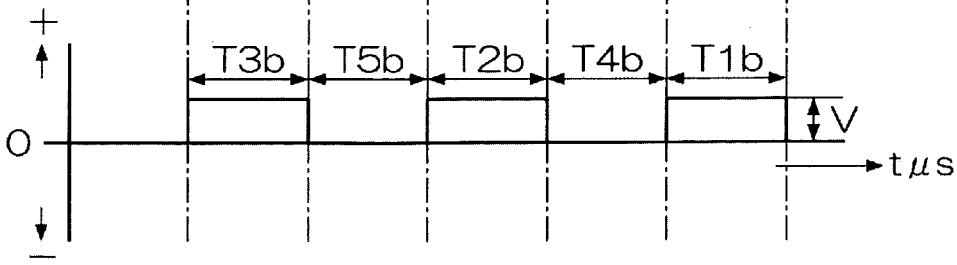
FIG. 20C Prior art
Figure 21:
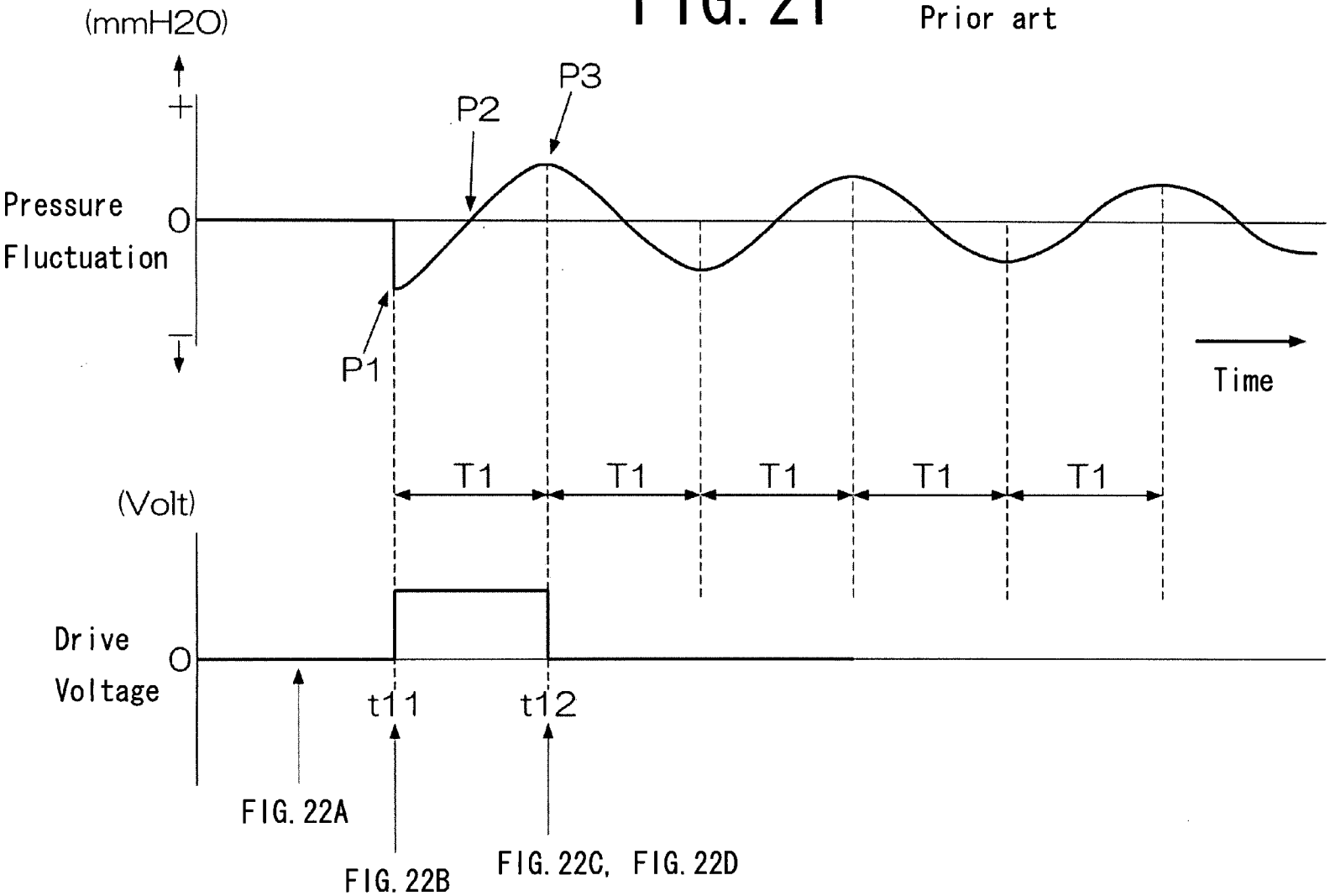
FIG. 21 Prior art
FIG. 21 is a graph showing a relation between a pressure fluctuation and a pulse waveform of a nozzle hole of the related art.

Further, in order to change the discharge volume of the ink which is allowed to fly from each of the nozzle holes 11 for the gradation expression, a positive electric field pulse with a time T2 shorter than the time T1 is applied before the final drive pulse shown in FIG. 4B with an interval of a time T4. As a result, the ink with a volume of two droplets is allowed to fly from each of the nozzle holes 11. In a similar manner, a positive electric field pulse with an application time T3 which is shorter than the duration T1 of the final drive pulse and is the same as the time T2 is operated before the pulse with the time T1 and the pulse with the time T2 of the positive electric field shown in FIG. 20C, with an interval of a time T5. Then, the ink with the volume of three droplets can be allowed to fly from each of the nozzle holes 11.

In this case, the positive drive pulses with the time T2 and the time T3, which are shorter than the final drive pulse with the time T1, are each referred to as initial drive pulse. The initial drive pulse has an application time shorter than that of the final drive pulse, but enables discharge of the same volume of ink droplets. The ink droplets discharged by the initial drive pulse with the time T2 or by the initial drive pulse with the time T3 are continuously discharged in a short period of time. Accordingly, the ink droplets are combined into large droplets during the flight between each of the nozzle holes 11 and the recording medium to be impacted on the recording medium, thereby enabling the gradation expression.

Note that, in the embodiment of the present invention, start-up times t1, t3, and t5 of each of the initial drive pulse and the final drive pulse are set to be constant with a cycle twice as long as the time T1. In addition, the plurality of nozzle holes 11 from which the ink should be discharged at the same timing are controlled so that the application times t5 of the final drive pulses match (synchronized) with each other. In other words, FIGS. 6A to 6C each show a drive waveform in a case of discharging ink with an amount of one droplet, two droplets, and three droplets from a given nozzle hole 11, respectively. In addition, it can be understood that FIGS. 6A to 6C each show a timing for discharging ink droplets with the amount of one droplet, two droplets, and three droplets from a plurality of different nozzle holes 11 at which recording positions are linearly arranged, assuming that time axes of the FIGS. 6A to 6C match with each other.

Figure 7:
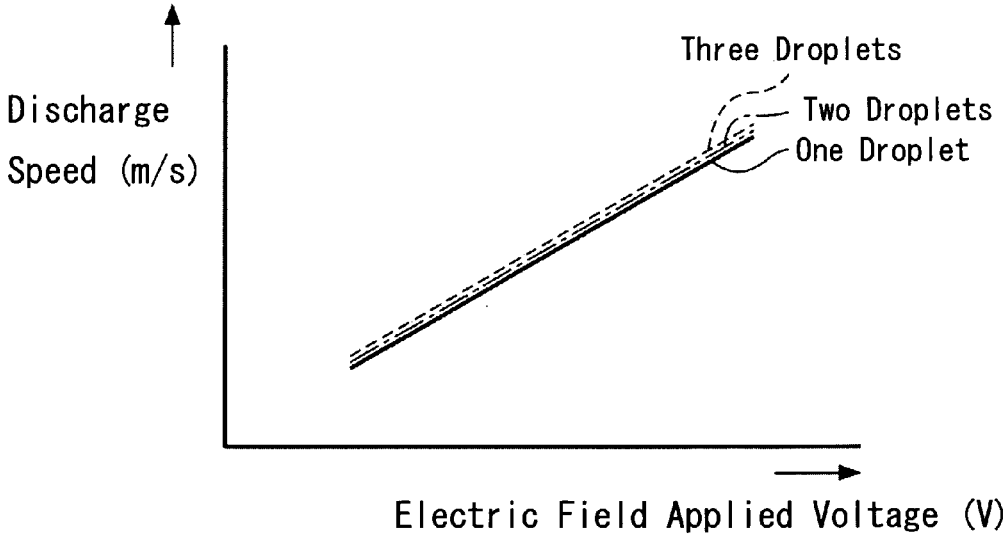
FIG. 7 is a graph showing a relation between an electric field applied voltage and a discharge speed of the ink-jet head according to the embodiment of the present-invention.
Figure 23:
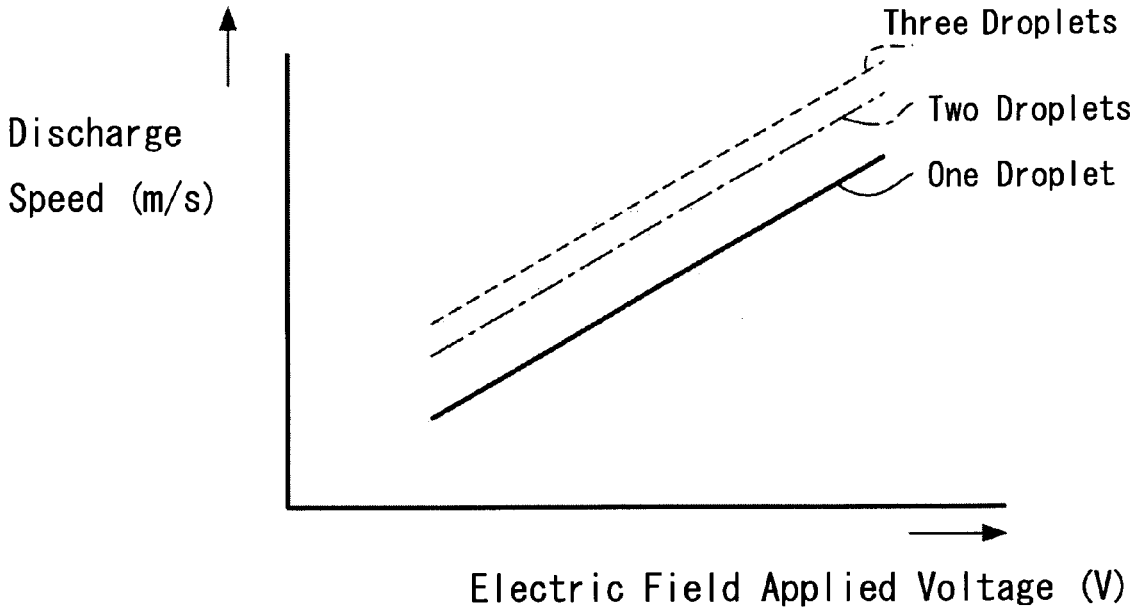
FIG. 23 Prior art
FIG. 23 is a graph showing a relation between an electric field applied voltage and a discharge speed of the ink-jet head of the related art.

Further, an experiment confirmed that when a relation between the pulse width T1 of the final drive pulse and the pulse widths T2 and T3 of the initial drive pulse was set as, for example, T1/2=T2=T3 as shown in FIGS. 6A to 6D with a pulse pressure V being commonly set, discharge speeds as shown in FIG. 7 could be obtained. In the initial drive pulses with the time T2 and the time T3, a discharge speed lower than that in a case of driving with the final drive pulse T1 in a single drive pulse is obtained as apparent from FIG. 8 showing the relation between the electric field application time and the discharge speed. Accordingly, depending on the initial drive pulse, the effect of the pressure change in each of the grooves 5 hardly remains when a subsequent discharge operation is performed, and the remainder of the vibration due to the driving operation is hardly added. For this reason, even when the discharge is performed a plurality of times, it is assumed that the difference in discharge speed for ink droplets does not increase as compared with a case where the constant drive pulse is applied a plurality of times for the time T1 shown in FIG. 23. As a result, as shown in FIG. 7, it is assumed that the discharge speed for each case can be set to substantially the same even when the volume of ink droplets is changed.

Under those conditions, the rest time (time during which actuator is not operated) T4 between the initial drive pulse and the final drive pulse, and the rest time T5 between the initial drive pulses are represented as T4=T5=T1+(T1−T2)=3×T2=3×T3. This indicates that a time (T1−T2), by which the time of the initial drive pulse becomes shorter than that of the final drive pulse, is added to the rest time, which is set as a new rest time. Conventionally, the rest time and the drive pulse application time each correspond to the constant time T1 (T1*b* to T5*b* of FIGS. 20A to 20C) during which the discharge of ink can be performed most efficiently, and the total of the application times and the rest times for the drive pulse corresponding to each discharge is twice as much as the time T1 and is constant. Also in the embodiment of the present invention, the total of the application times of the initial drive pulse and the rest times is set to be twice as much as the time T1 and to be constant, thereby making it possible to continuously discharge ink with efficiency as in the conventional case. Specifically, for example, when the time T1 is 12 μsec, the time T2 and the time T3 are each 6 μsec, and the time T4 and the time T5 are each 18 μsec.

Further, as another embodiment of the present invention, as shown in FIG. 6D, the application times T2*a* and T3*a* of the initial drive pulse can be set to be longer than the application time T1 of the final drive pulse. In this case, for example, it is assumed that the pulse voltage V is commonly set, and T2*a*=T3*a*=T1×(3/2) is satisfied. As shown in FIG. 8, also by setting the times T2*a* and T3*a* of the initial drive pulse to be longer than the time T1 of the final drive pulse, a lower discharge speed can be achieved. In addition, a rest time T4*a* between the initial drive pulse and the final drive pulse, and a rest time T5*a* between the initial drive pulses in the case of the embodiment of the present invention are represented as T4*a*=T5*a*=T1+(T1−T2*a*)=T1−T1/2=T1/2. When the initial drive pulse becomes longer than the time T1 of the final drive pulse, the rest time becomes shorter by that amount. As a result, the total of the drive pulses and the rest times can be set to be twice as much as the time T1 and to be constant, thereby making it possible to discharge ink with efficiency as in the conventional case.

Figure 11:
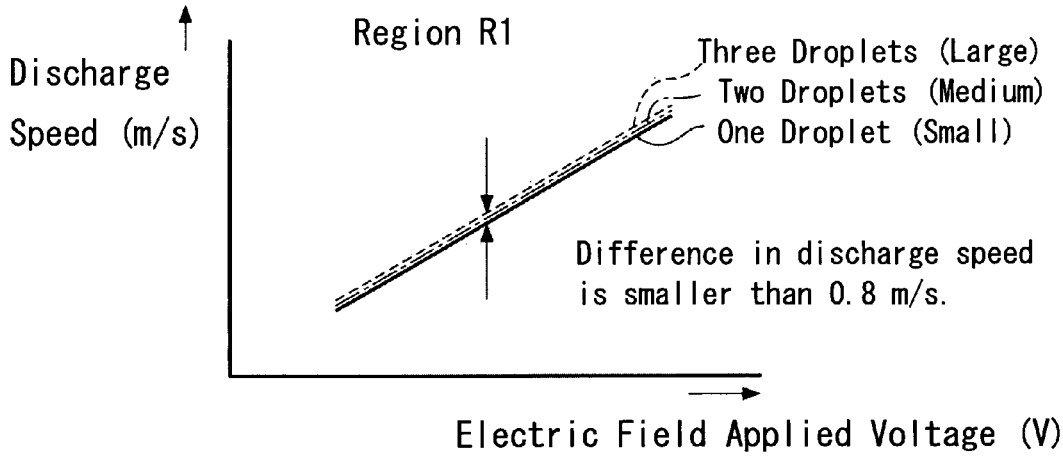
FIG. 11 is a graph showing a relation between the electric field applied voltage and the discharge speed of the ink-jet head in a region R1 shown in FIGS. 9 and 10.

Next, with reference to FIGS. 9 to 17, a description is given of results of a study on setting conditions for each of the initial drive pulse and the final drive pulse. FIG. 9 is a table showing results of an experiment for confirming how the ink is discharged when the application time of the initial drive pulse is changed within a range equal to or smaller than the time T1, by using the ink-jet head 100 having a characteristic of a final drive pulse T1=7.6 μs. In a region R1 in which the application time of the initial drive pulse is 5.1 μs (value obtained by dividing T1 by application time: 1.5) to 2.6 μs (value obtained by dividing T1 by application time: 2.9), the difference in discharge speed among one droplet (small ink droplet), two droplets (medium ink droplet), and three droplets (large ink droplet) falls within a variation range of 0.8 m/s as shown in FIG. 11. In this case, the value obtained by dividing T1 by the application time represents a value obtained by dividing the duration of the final drive pulse T1 by the duration (application time) of the initial drive pulse. The range from 1.5 to 2.9 represents a range in which the duration of the initial drive pulse is set from 1/1.5 to 1/2.9 of the duration of the final drive pulse.

Note that FIG. 11 shows results of measurement of the relation between the applied voltage and the discharge speed at a certain set time in the range R1 by changing the amount of ink. The variation value of 0.8 m/s is a value empirically obtained as a value for holding the image quality of the recording results in a desired range in the ink-jet head having a characteristic of an ink discharge speed of about 5 m/s. When the value falls within the range, a large number of subjects visually probably consider the image quality excellent. In addition, the range set as a control target is a range which is considered to be set as a design value by taking ambient conditions and manufacturing conditions into consideration. Under those conditions, a range of the application time of 4.5 μm to 3.0 μm (range in which duration of initial drive pulse is set from 1/1.7 to 1/2.5 of duration of final dive pulse) is considered to be suitable as the control target.

Figure 12:
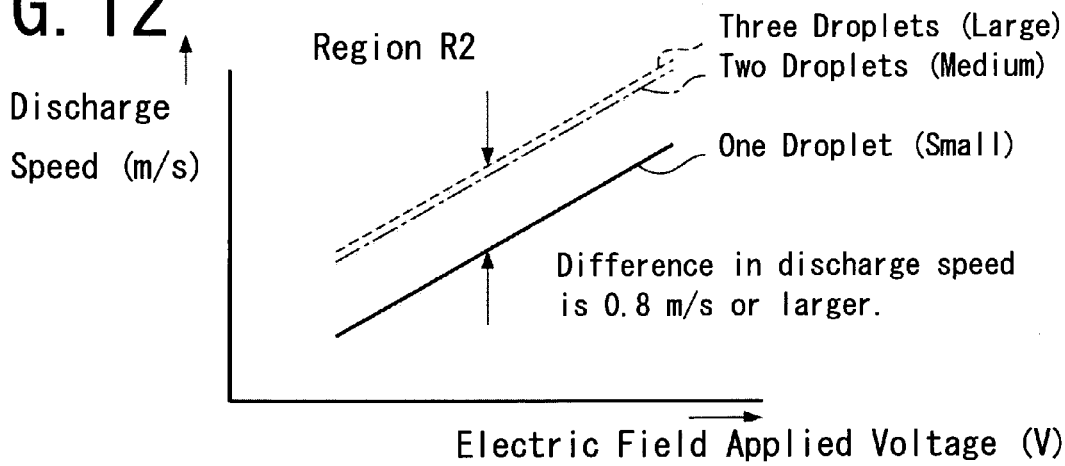
FIG. 12 is a graph showing a relation between the electric field applied voltage and the discharge speed of the ink-jet head in a region R2 shown in FIGS. 9 and 10.
Figure 13:
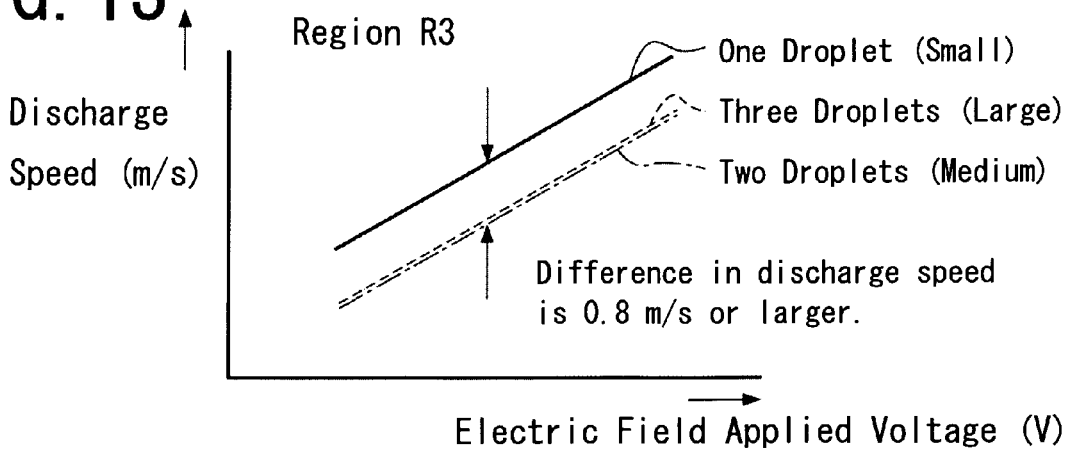
FIG. 13 is a graph showing a relation between the electric field applied voltage and the discharge speed of the ink-jet head 100 in a region R3 shown in FIGS. 9 and 10.

On the other hand, when the time of the initial drive pulse is set to be equal to or larger than 5.4 μm (value obtained by dividing T1 by application time: 1.4 or smaller) (region R2), as shown in FIG. 12, the discharge speed for each of the ink droplets with the amounts corresponding to two droplets and three droplets is larger than the discharge speed for the amount of ink corresponding to one droplet, and the difference in discharge speed is 0.8 m/s or larger. In addition, when the time of the initial drive pulse is set to be equal to or smaller than 2.5 μm (value obtained by dividing T1 by application time: 3 or larger) (region R3), as shown in FIG. 13, the discharge speed for each of the ink droplets with the amounts of ink corresponding to two droplets and three droplets is smaller than the discharge speed for the amount of ink corresponding to one droplet, and the difference in discharge speed is 0.8 m/s or larger.

Further, FIG. 10 shows results of an experiment for confirming how the ink is discharged when the application time of the initial drive pulse is changed within a range equal to or larger than the time T1, by using the same ink-jet head 100. In the region R1 in which the application time of the initial drive pulse is 9.1 μs (value obtained by dividing T1 by application time: 1.2) to 13.7 us (value obtained by dividing T1 by application time: 1.8), the difference in discharge speed among one droplet (small ink droplet), two droplets (medium ink droplet), and three droplets (large ink droplet) falls within the variation range of 0.8 m/s as shown in FIG.11. A range of the application time from 10.3 μm (value obtained by dividing application time by T1: 1.35) to 13.3 μm (value obtained by dividing application time by T1: 1.75) is considered to be suitable as the control target. In other words, the duration of the initial drive pulse is set to be 1.2 times to 1.8 times as much as the duration of the final drive pulse, thereby obtaining an excellent image quality. In this case, the range from 1.35 times to 1.75 times seems to be suitable as the control target.

On the other hand, when the time of the initial drive pulse is set to be equal to or smaller than 8.7 μs (value obtained by dividing application time by T1: 1.15 or smaller) (region R2), as shown in FIG. 12, the discharge speed for each of the ink droplets with the amounts corresponding to two droplets and three droplets is larger than the discharge speed for the amount of ink corresponding to one droplet, and the difference in discharge speed is 0.8 m/s or larger. In addition, when the time of the initial drive pulse is set to be equal to or larger than 14.1 μs (value obtained by dividing application time by T1: 1.85 or larger) (region R3), as shown in FIG. 13, the discharge speed for each of the ink droplets with the amounts of ink corresponding to two droplets and three droplets is smaller than the discharge speed for the amount of ink corresponding to one droplet, and the difference in discharge speed is 0.8 m/s or larger.

Figure 14:
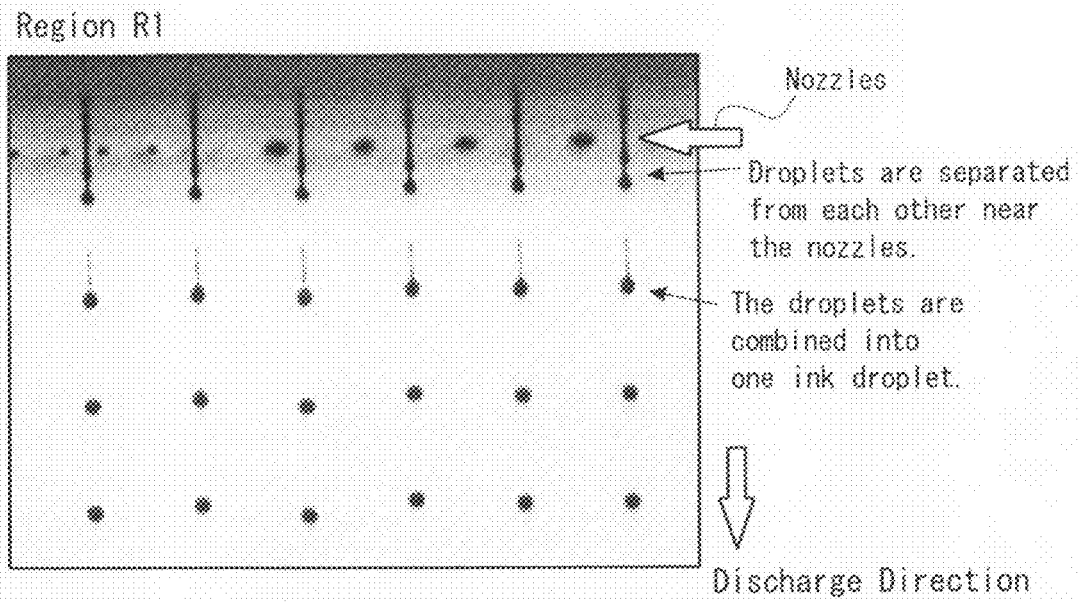
FIG. 14 is a diagram showing a photographed image of the discharge state in the region R1 shown in FIGS. 9 and 10.
Figure 15:
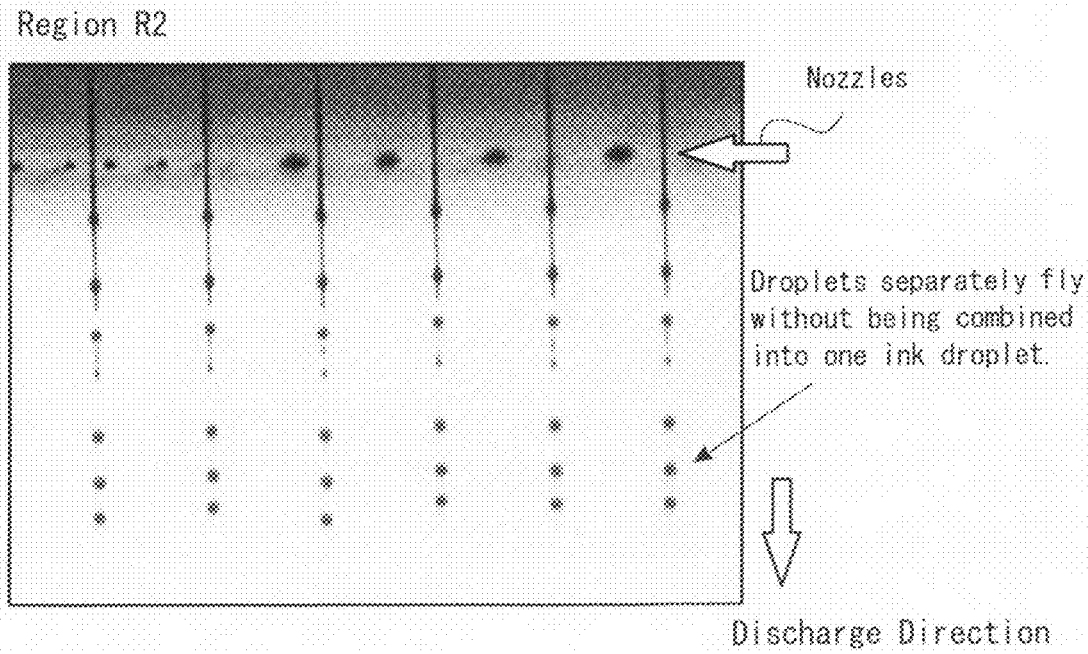
FIG. 15 is a diagram showing a photographed image of the discharge state in the region R2 shown in FIGS. 9 and 10.

FIG. 14 is a photograph showing a discharge state, which is taken under conditions of the region R1, and FIG. 15 is a photograph showing a discharge state, which is taken under conditions of the region R2. In both cases, the ink with the amount corresponding to three droplets is repeatedly discharged by the application of three drive pulses. In the case where the ink is discharged under the conditions of the region R1 shown in FIG. 14, in a state obtained before the ink is discharged from each of the nozzle holes 11, first to third droplets are separated from each other near the nozzles (in the photograph, the first droplet and the second droplet are combined into one droplet, and the third droplet is separated to a small extent), but three ink droplets are combined into one ink droplet immediately after being discharged and separated from each of the nozzle holes 11. On the other hand, in the case where the ink is discharged under certain conditions of the region R2 shown in FIG. 15, the three ink droplets separately fly without being combined into one ink droplet as taken from a photograph. In this case, it is difficult for the ink adhered to the medium to form a well-defined circular shape.

Note that the photographs of FIGS. 14 and 15 are taken in a state where 8000 ink droplets are discharged per second at an initial speed of ink droplets of about 5 m/s.

Figure 16:
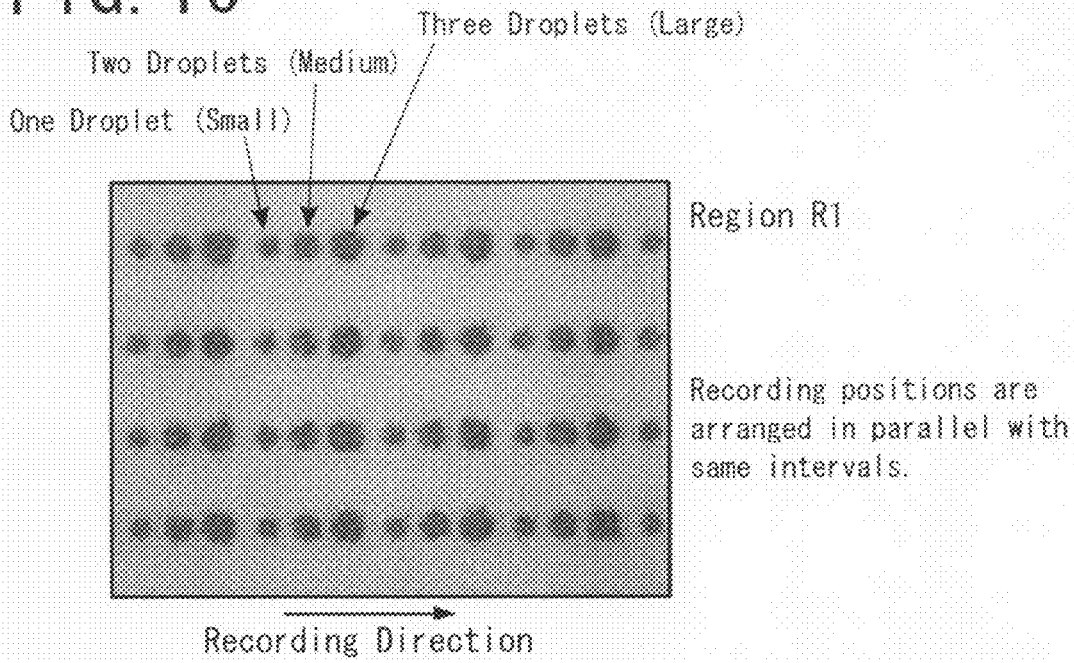
FIG. 16 is a diagram showing a photographed image of a discharge result on a recording medium in the region R1 shown in FIGS. 9 and 10.
Figure 17:
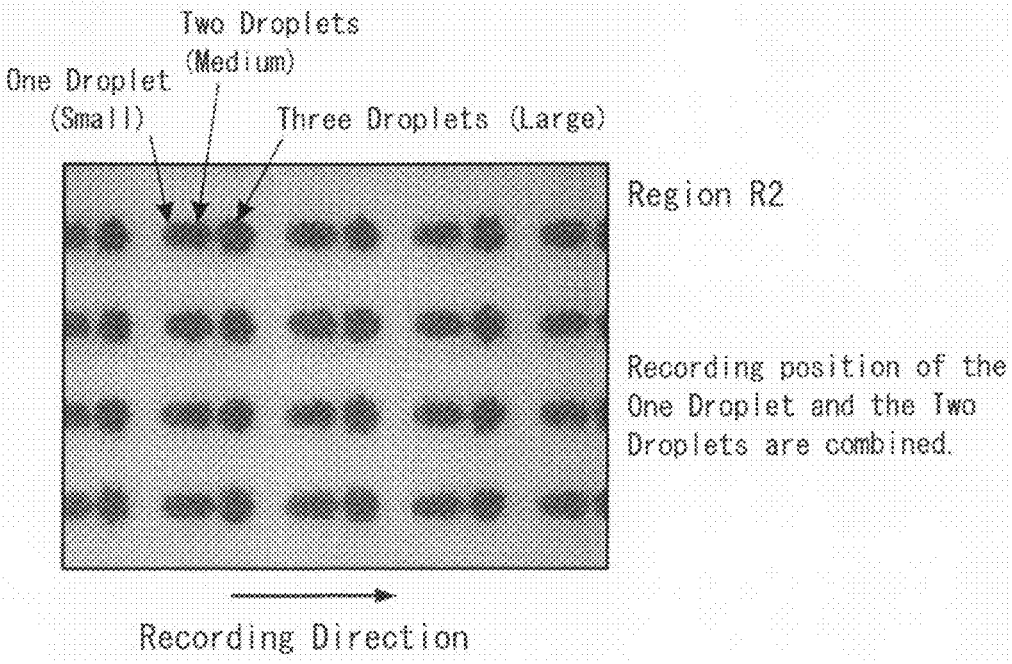
FIG. 17 is a diagram showing a photographed image of a discharge result on a recording medium in the region R2 shown in FIGS. 9 and 10.

FIGS. 16 and 17 each show recording results obtained after repeatedly discharging the ink with the amount of one droplet, two droplets, and three droplets onto the recording medium from four nozzle holes 11 while the ink-jet head 100 is moved. FIG. 16 shows the recording results when the drive voltage is controlled under the conditions of the region R1, and FIG. 17 shows the recording results when the drive voltage is controlled under the conditions of the region R2. Under the conditions of the region R1 shown in FIG. 16, the discharge speed is set to be the same irrespective of the amount of ink, so recording positions are arranged in parallel with each other with the same intervals in a recording direction.

On the other hand, under the conditions of the region R2 shown in FIG. 17, the discharge speed for the ink droplet corresponding to one droplet is lower than that for the ink droplets corresponding to two droplets and three droplets as shown in FIG. 12. Accordingly, the recording position of the ink with the amount of one droplet and the recording position of the ink with the amount of two droplets are combined with each other. Note that in the recording of each of FIGS. 16 and 17, an interval between the ink-jet head 100 and the recording medium is 2 mm, and a movement speed of the ink-jet head 100 is 1 m/s.

Note that the experimental results shown in FIGS. 9 and 10 are obtained when the ink-jet head 100 having the characteristic of the final drive pulse T1=7.6 μs is used. In addition, the ink-jet head 100 having a characteristic of the final drive pulse T1=5.2 μs is also confirmed, and it is found that the same results (relation between time ratio between final drive pulse and initial drive pulse, and discharge state) can be obtained.

In the embodiment of the present invention, the discharge as shown in each of FIGS. 6A to 6C and the discharge shown in each of FIGS. 6A and 6D are continuously performed in an arbitrary combination thereof based on gradation data, thereby making it possible to discharge ink droplets with different amounts to perform arbitrary gradation expression on the recording medium.

As described above, in the ink-jet head 100 according to the embodiment of the present invention, the ink discharge speeds at the time of discharging the ink with the amounts of two droplets and three droplets are equal to each other as compared with the discharge speed at the time of discharging one droplet. Accordingly, there can be provided a printed material with an excellent quality with no difference in impact positions of ink droplets when the printing is performed using an ink-jet printer.

Note that, in the embodiment of the present invention, the discharge of the ink with the amount of one droplet, two droplets, and three droplets is described above. However, an upper limit of the ink droplet amount is not particularly limited. Rectangular waves with the electric field application times of T1, T2, and T3 are used at the signal applied voltage V used in the embodiment of the present invention. However, the waveform and the signal applied voltage which smooth the start-up may be gradually changed during the electric field application time, and the waveform is not limited to a particular waveform.

Figure 18A:
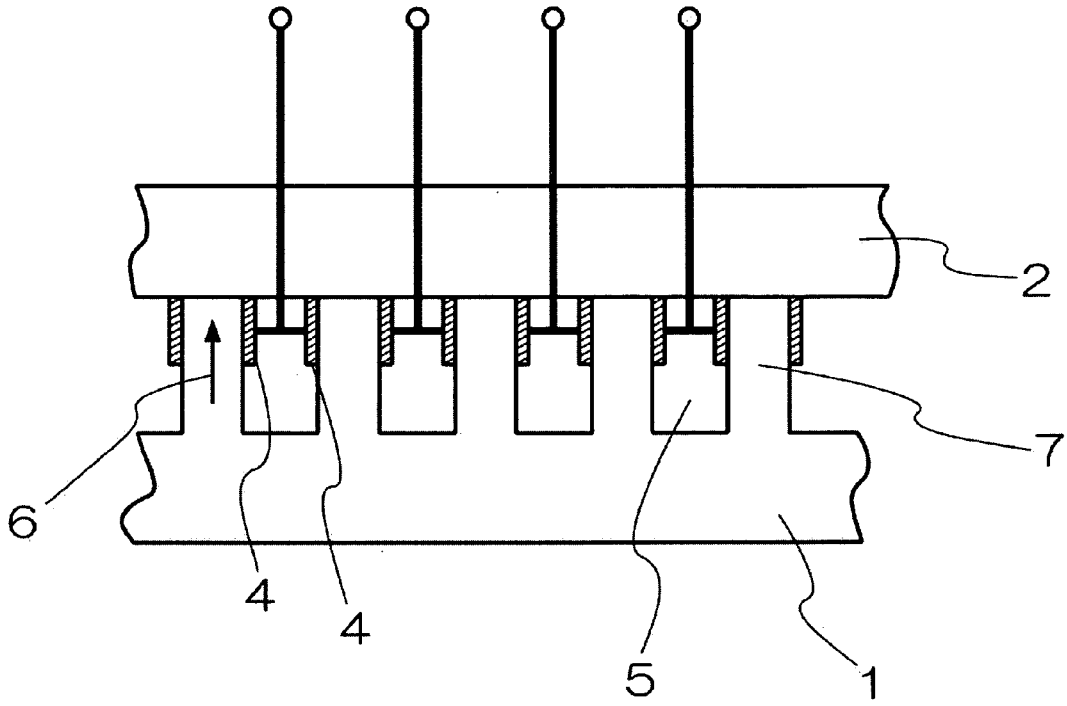
FIGS. 18A and 18B are cross-sectional diagrams each showing a wiring state of electrodes of the ink-jet head according to another embodiment of the present invention.
Figure 18B:
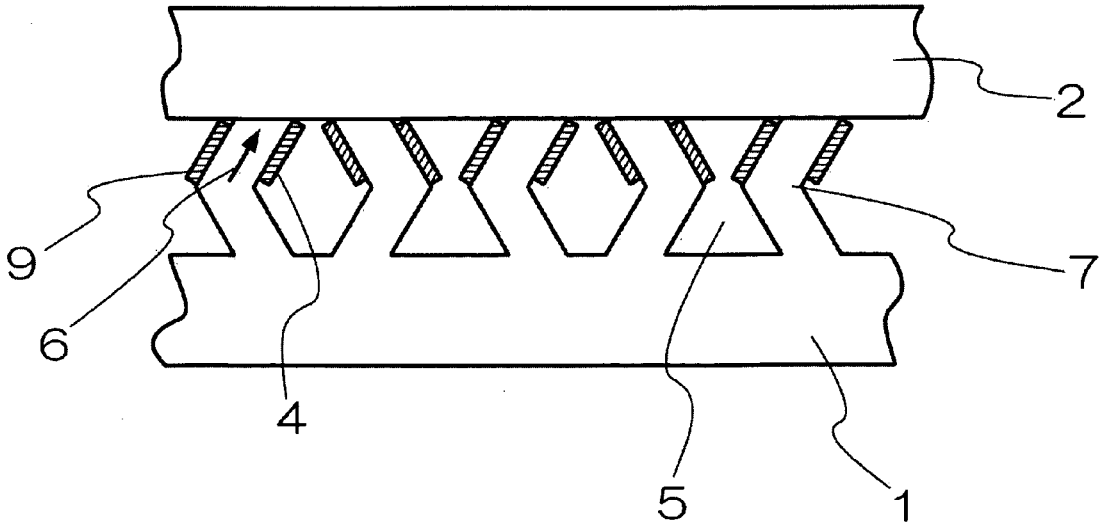
Figure 19:
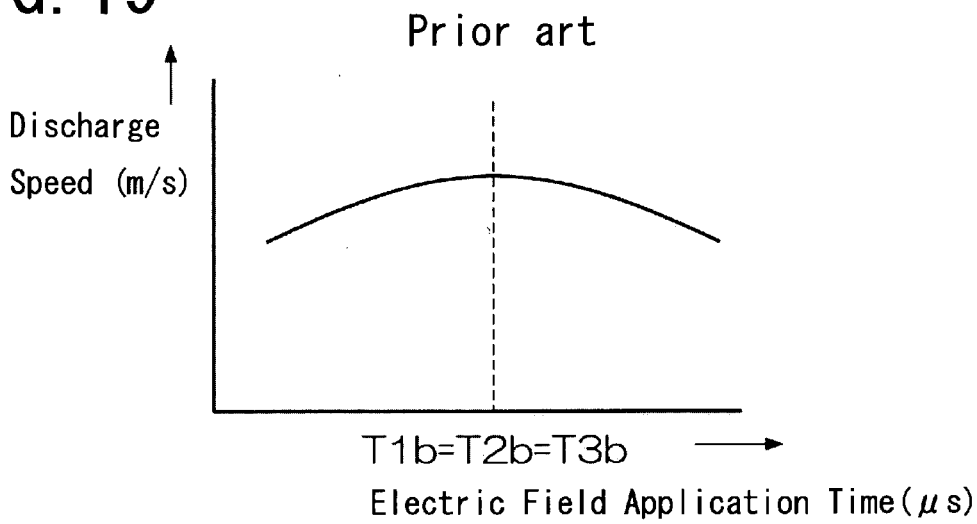
FIG. 19 is a graph showing a relation between an electric field application time and a discharge speed of an ink-jet head of a related art.

In addition, in the ink-jet head 100 used in the embodiment of the present invention, the case where the electrode 4 formed on each of the grooves 5 is the common electrode with the ground potential, and the electrodes 9 are formed so as to sandwich the electrode 4 is described. However, there arises no problem when every two side walls 7 are driven by a wiring method as shown in FIG. 18 showing another wiring state of electrodes.

What is claimed is:

1. A method of driving an ink-jet head, comprising:

providing an ink-jet head comprising: a substrate having an ink flow path for supplying ink, a plurality of partition walls spaced apart at a preselected interval to form a plurality of grooves arranged parallel to one another and disposed in communication with the ink flow path for receiving ink, the partition walls having deformable side walls; a plurality of electrodes each connected to the respective side walls to form an actuator that is driven by a drive pulse to deform the side walls to vary the volume in the grooves to thereby eject ink from the grooves; a nozzle plate connected to the substrate and having a plurality of nozzle openings each disposed in communication with respective ones of the grooves so that when the actuators are driven ink is ejected from the grooves through the nozzle openings and onto a recording medium; application means for applying to the actuators a drive pulse with a predetermined voltage to drive the actuators by deformation of the side walls to thereby eject ink from the grooves through the nozzle openings while providing a rest time during which the actuators are not driven; and control means for generating a plurality of drive pulses that are applied by the application means for one-dot print cycle to change a discharge volume of the ink ejected from the grooves through the nozzle openings and onto the recording medium; and setting, by the control means, a duration of each of an initial drive pulse and a final drive pulse, from among the plurality of generated drive pulses, so that the duration of the initial drive pulse is set to a value in the range of from 1/1.5 to 1/2.9 of the duration of the final drive pulse;

wherein in one-dot print cycle, each of a total time consisting of the duration of one of the initial drive pulses and a corresponding rest time is set to be constant with one another and twice the duration of the final drive pulse.

2. A method of driving an ink-jet head according to claim 1; wherein the duration of the initial drive pulse is set to a value in the range of from 1/1.7 to 1/2.5 of the duration of the final drive pulse.

3. A method of driving an ink-jet head, comprising:

providing an ink-jet head comprising: a substrate having an ink flow path for supplying ink, a plurality of partition walls spaced apart at a preselected interval to form a plurality of grooves arranged parallel to one another and disposed in communication with the ink flow path for receiving ink, the partition walls having deformable side walls; a plurality of electrodes each connected to the respective side walls to form an actuator that is driven by a drive pulse to deform the side walls to vary the volume in the grooves to thereby eject ink from the grooves; a nozzle plate connected to the substrate and having a plurality of nozzle openings each disposed in communication with respective ones of the grooves so that when the actuators are driven ink is ejected from the grooves through the nozzle openings and onto a recording medium; application means for applying to the actuators a drive pulse with a predetermined voltage to drive the actuators by deformation of the side walls to thereby eject ink from the grooves through the nozzle openings while providing a rest time during which the actuators are not driven; and control means for generating a plurality of drive pulses that are applied by the application means for one-dot print cycle to change a discharge volume of the ink ejected from the grooves through the nozzle openings and onto the recording medium; and setting, by the control means, a duration of each of an initial drive pulse and a final drive pulse, from among the plurality of generated drive pulses, so that the duration of the initial drive pulse is set to a value in the range of from 1/1.5 to 1/2.9 of the duration of the final drive pulse or to a value in the range of from 1.2 to 1.8 times of the duration of the final drive pulse;

wherein in one-dot print cycle, each of a total time consisting of the duration of one of the initial drive pulses and a corresponding rest time is set to be constant with one another and twice the duration of the final drive pulse.

4. A method according to claim 1; further comprising the step of controlling, by the control means, the application means to apply final drive pulses to the respective electrodes to eject ink from the respective nozzle openings so that the final drive pulses are synchronized with one another.

5. A method according to claim 3; further comprising the step of controlling, by the control means, the application means to apply final drive pulses to the respective electrodes to eject ink from the respective nozzle openings so that the final drive pulses are synchronized with one another.

6. An ink-jet head comprising:

a substrate having an ink flow path for supplying ink, a plurality of partition walls spaced apart at a preselected interval to form a plurality of grooves arranged parallel to one another and disposed in communication with the ink flow path for receiving ink, the partition walls having deformable side walls;

a plurality of electrodes each connected to the respective side walls to form an actuator that is driven by a drive pulse to deform the side walls to vary the volume in the grooves to thereby eject ink from the grooves;

a nozzle plate connected to the substrate and having a plurality of nozzle openings each disposed in communication with respective ones of the grooves so that when the actuators are driven ink is ejected from the grooves through the nozzle openings and onto a recording medium;

application means for applying to the actuators a drive pulse with a predetermined voltage to drive the actuators by deformation of the side walls to thereby eject ink from the grooves through the nozzle openings while providing a rest time during which the actuators are not driven; and control means for generating a plurality of drive pulses that are applied by the application means for one-dot print cycle to change a discharge volume of the ink ejected from the grooves through the nozzle openings and onto the recording medium, and for setting a duration of each of an initial drive pulse and a final drive pulse, from among the plurality of generated drive pulses, so that the duration of the initial drive pulse is set to a value in the range of from 1/1.5 to 1/2.9 of the duration of the final drive pulse or to a value in the range of from 1.2 to 1.8 times of the duration of the final drive pulse;

wherein in one-dot print cycle, each of a total time consisting of the duration of one of the initial drive pulses and a corresponding rest time is set to be constant with one another and twice the duration of the final drive pulse.

7. An ink-jet recording apparatus comprising: an ink-jet head according to claim 6; an ink supply part for supplying ink to the ink-jet head; and recording medium transport means for transporting a recording medium onto which ink is discharged from the ink-jet head.

* * * * *